United States Patent [19]

Hirano

[11] Patent Number: 4,544,333

[45] Date of Patent: Oct. 1, 1985

[54] CAPABILITY CONTROL APPARATUS FOR A COMPRESSOR

[75] Inventor: Takahisa Hirano, Nagoya, Japan

[73] Assignee: Mitsubishi Jukogyo Kabushiki Kaisha, Tokyo, Japan

[21] Appl. No.: 635,463

[22] Filed: Jul. 25, 1984

Related U.S. Application Data

[63] Continuation of Ser. No. 303,568, Sep. 18, 1981, abandoned.

[30] Foreign Application Priority Data

Sep. 19, 1980 [JP] Japan ..... 55-129196
Mar. 30, 1981 [JP] Japan ..... 56-45600

[51] Int. Cl.[4] ..... F04B 49/00

[52] U.S. Cl. ..... 417/299; 417/309; 417/310

[58] Field of Search ..... 417/299, 301, 309, 310

[56] References Cited

U.S. PATENT DOCUMENTS

| | | | |
|---|---|---|---|
| 2,933,158 | 4/1960 | Pitts | 417/310 X |
| 3,041,847 | 7/1962 | Harter et al. | 417/309 X |
| 3,182,596 | 5/1965 | Prijatel | 417/309 |
| 3,224,662 | 12/1965 | Oldberg | 417/309 X |
| 4,060,343 | 11/1977 | Newton | 417/309 |
| 4,222,712 | 9/1980 | Huber | 417/309 |

*Primary Examiner*—Richard E. Gluck
*Attorney, Agent, or Firm*—Toren, McGeady, Stanger, Goldberg & Kiel

[57] ABSTRACT

A capability control apparatus for a compressor wherein gas sucked into a compression chamber is compressed due to a decrease in volume of the compression chamber. The pressure of the gas sucked into the compression chamber, in response to an increase or decrease in load, is automatically controlled by varying the volume of the compression chamber based on the pressure of the sucked gas.

2 Claims, 34 Drawing Figures

FIG.22
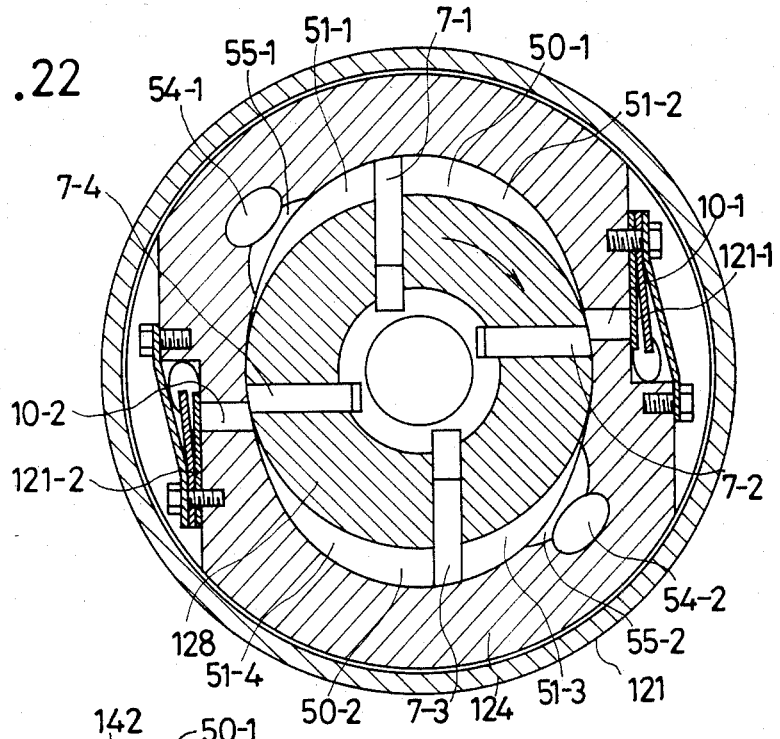
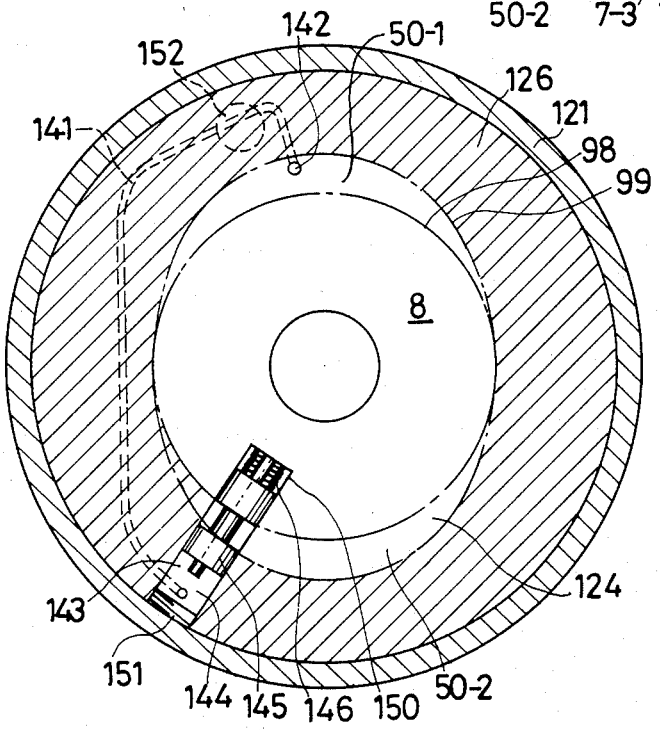
FIG.24

FIG.27
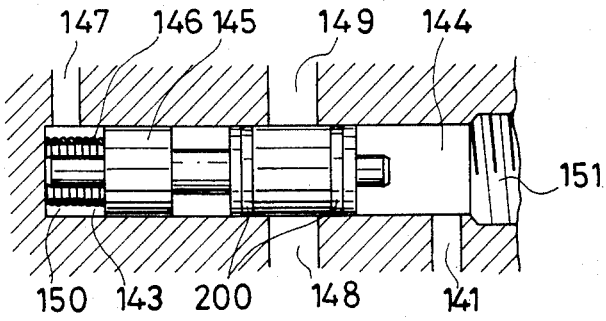
FIG.27a
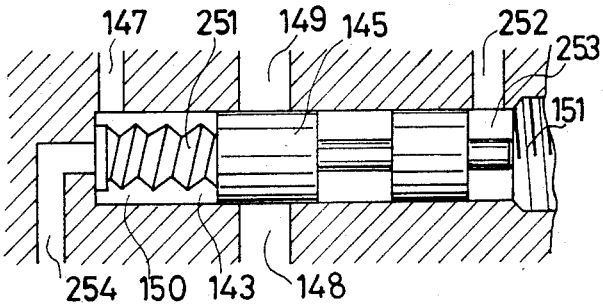
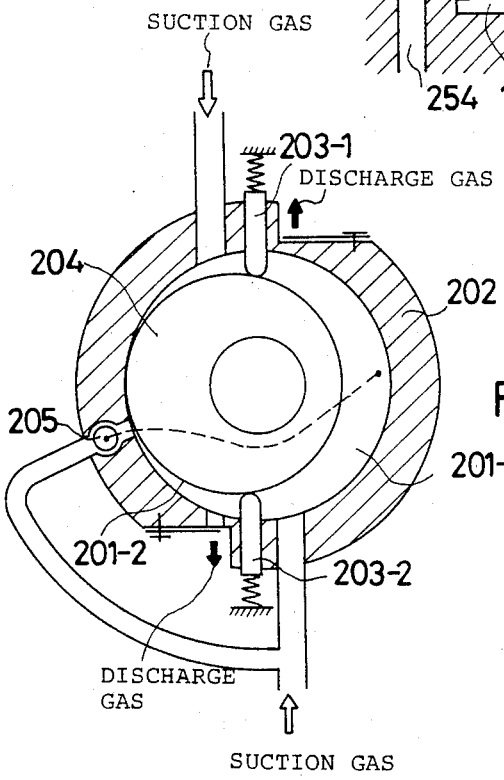
FIG.28

CAPABILITY CONTROL APPARATUS FOR A COMPRESSOR

This is a continuation of application Ser. No. 303,568, filed Sept. 18, 1981, now abandoned.

DETAILED DESCRIPTION OF THE INVENTION

The present invention relates to a capability control apparatus which is applicable to compressors, particularly to air-conditioning and freezing apparatuses for vehicles.

The most conventional capability control method for vehicular freezing and air-conditioning apparatus has employed an ON and OFF control of the compressor, which comprises sensing, by a thermostat, an air temperature inside of a freezer or a vehicle or a temperature of air blown out of an evaporator, cutting off energization to a magnetic clutch which transmits engine power to the compressor in order to stop the compressor when the air temperature has fallen below a set temperature of said thermostat, and re-energizing the magnetic clutch when the air temperature has again risen above the set temperature.

In the method as described above, since the number of revolutions of the compressor driven by the engine increases particularly when the vehicle runs at a high speed, the capability of the compressor increases with the result that there occurs a drop in suction pressure of the compressor, a rise in discharge pressure and an increase in power consumption, and the operation of the compressor is sometimes stopped due to growth of frost on the evaporator, actuation of a high pressure protective device, and the like. For this reason, to control the capability of the compressor during operation and to reduce its power, there has been proposed a method, in a screw compressor, for moving a position of suction completion to control a displacement and a discharge amount. In the following, this method will be schematically described.

In the past, the prior art of this kind which switches or changes-over the mode of operation from unload to full load or vice versa using a magnetic valve has suffered from significant disadvantages as follows:

(1) The magnetic valve and its mounting construction are very complicated and require a high reliability as shown in FIG. 2, which will be discussed hereinafter.

(2) Circuits for detection and command of external signals to turn on and off the magnetic valve are separately necessary.

(3) Since the magnetic valve is mounted on the compressor, the compressor increases in dimension and weight.

It is therefore an object of the present invention to eliminate these disadvantages noted above with respect to the prior art. That is, the present invention provides an automatic unloader which (a) uses no highly reliable device such as a magnetic valve, (b) automatically enters the unload operation in case of operating conditions of the compressor requiring no relatively great capability, and automatically switches into the full load operation in case of conditions requiring a great capability conversely to the former, and (c) rarely influences the size and weight of the compressor even if the unloader is mounted.

In accordance with the present invention, there is provided a capability control apparatus for a volume type compressor in which gas sucked into a compression chamber due to a decrease in volume of the compression chamber is compressed, and pressure of the gas sucked into the compression chamber is increased or decreased in response to an increase or decrease in load, characterized by the provision of a bypass hole for communicating said compression chamber with a region of suction pressure until the volume of said compression chamber decreases from its maximum to a predetermined level, and an unloader piston adapted to open said bypass hole when the sucked pressure has fallen or the suction action decreases below a predetermined value and to close said bypass hole when the sucked pressure or the suction action has increased above the predetermined value.

Also, in accordance with the present invention, there is provided a capability control apparatus for a compressor wherein in a volume type compressor having a plurality of independent cylinder chambers, an unloader device having an unloader piston is provided, said unloader piston being loaded with in-cylinder pressure of one of said cylinder chambers and low pressure of the compressor, said unloader piston being moved in proportion to a magnitude of said low pressure, and a discharge amount of said one cylinder to the other cylinder chamber according to the position of said unloader piston is automatically controlled by the magnitude of the low pressure.

Thus, the object of the present invention is to provide a compressor which is simple in construction and has a capability control function presenting a better operation.

Embodiments of the present invention will now be described with reference to the accompanying drawings.

Figure 15A:
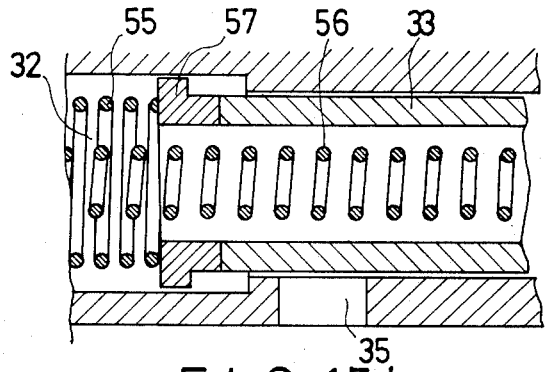
Figure 15B:
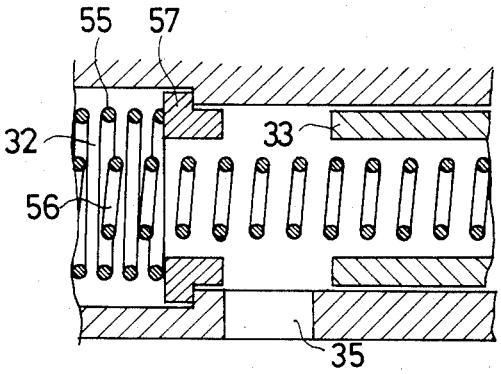
Figure 15C:
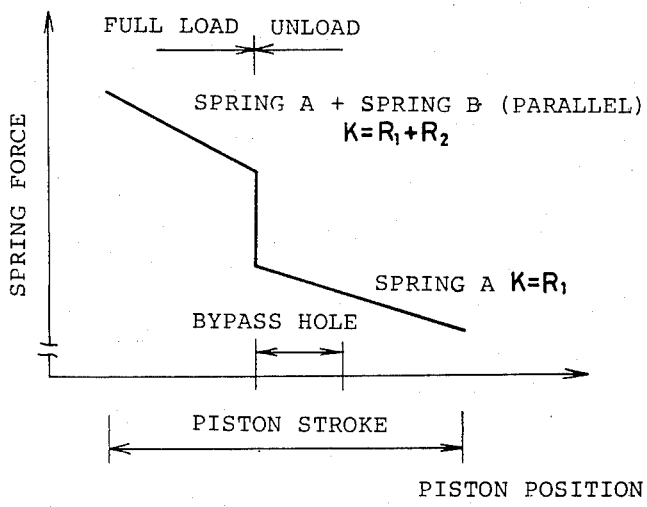
Figure 16:
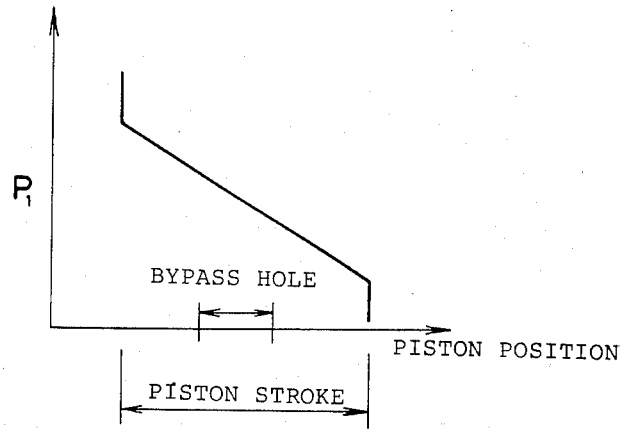
Figure 17:
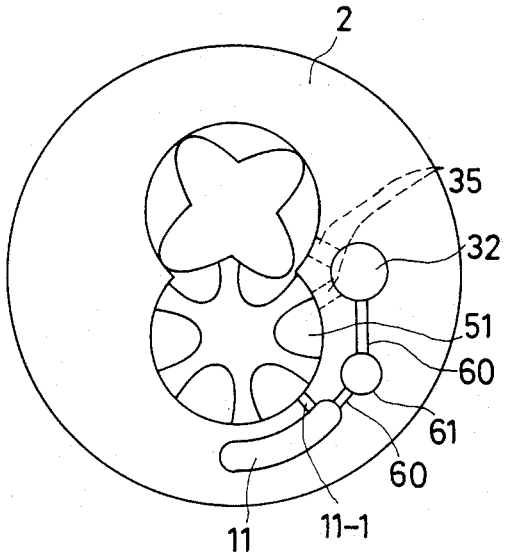
Figure 18A:
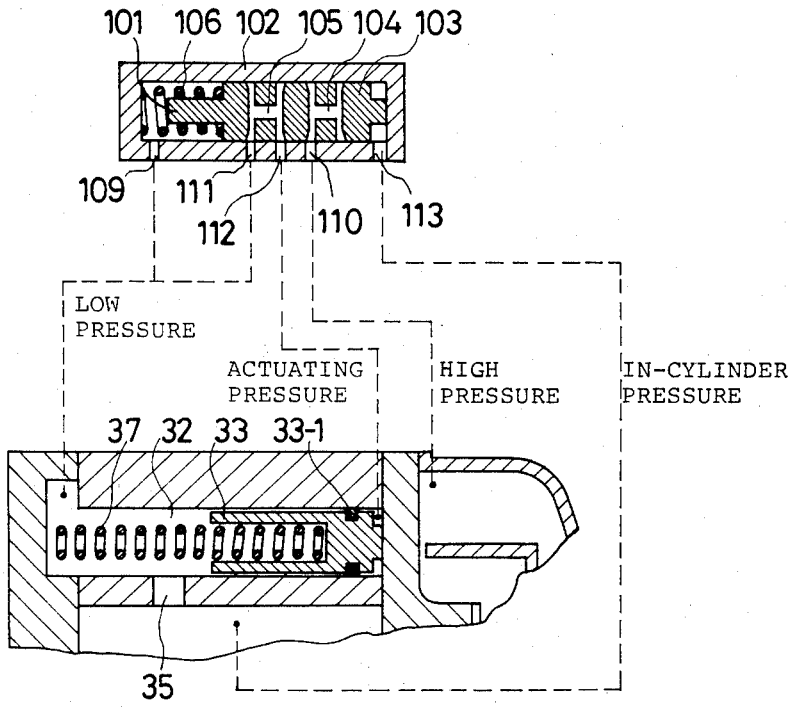
Figure 18B:
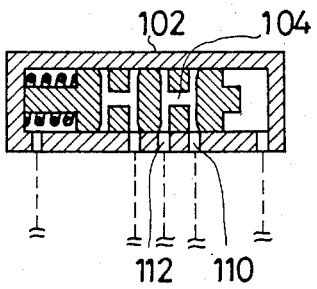
Figure 19:
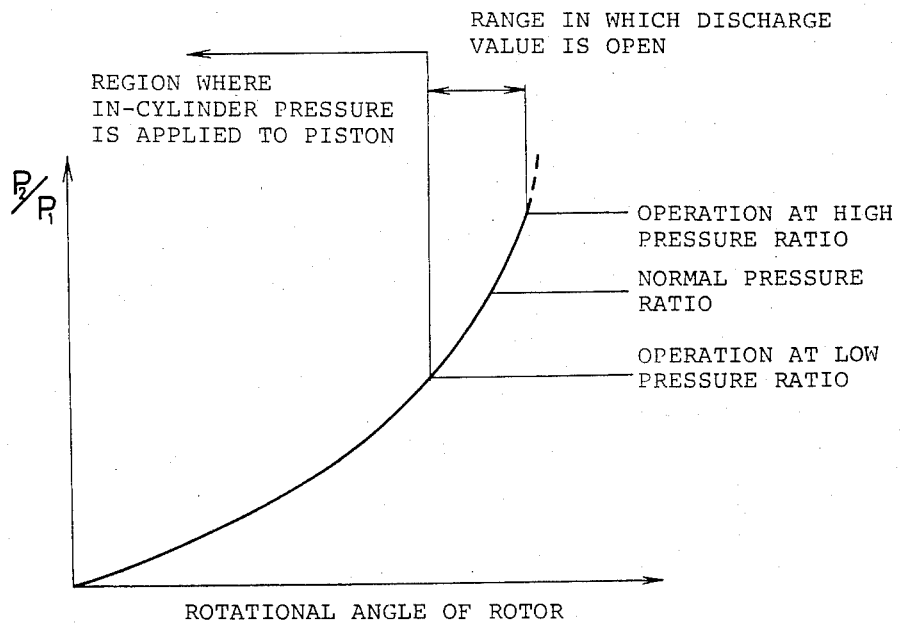
Figure 20:
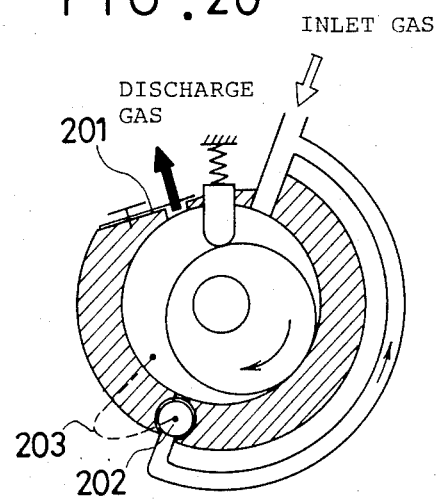
Figure 21:
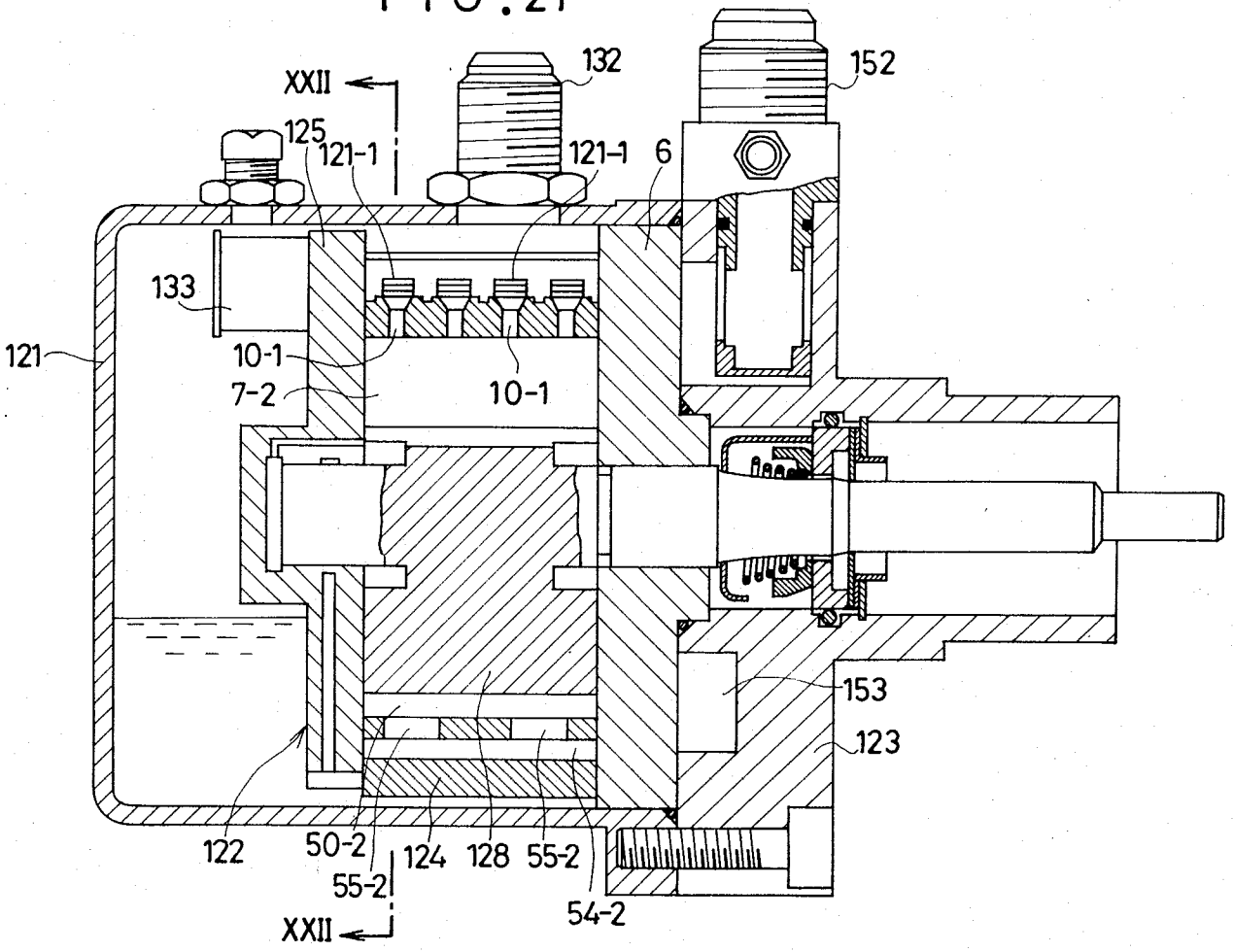
Figure 23:
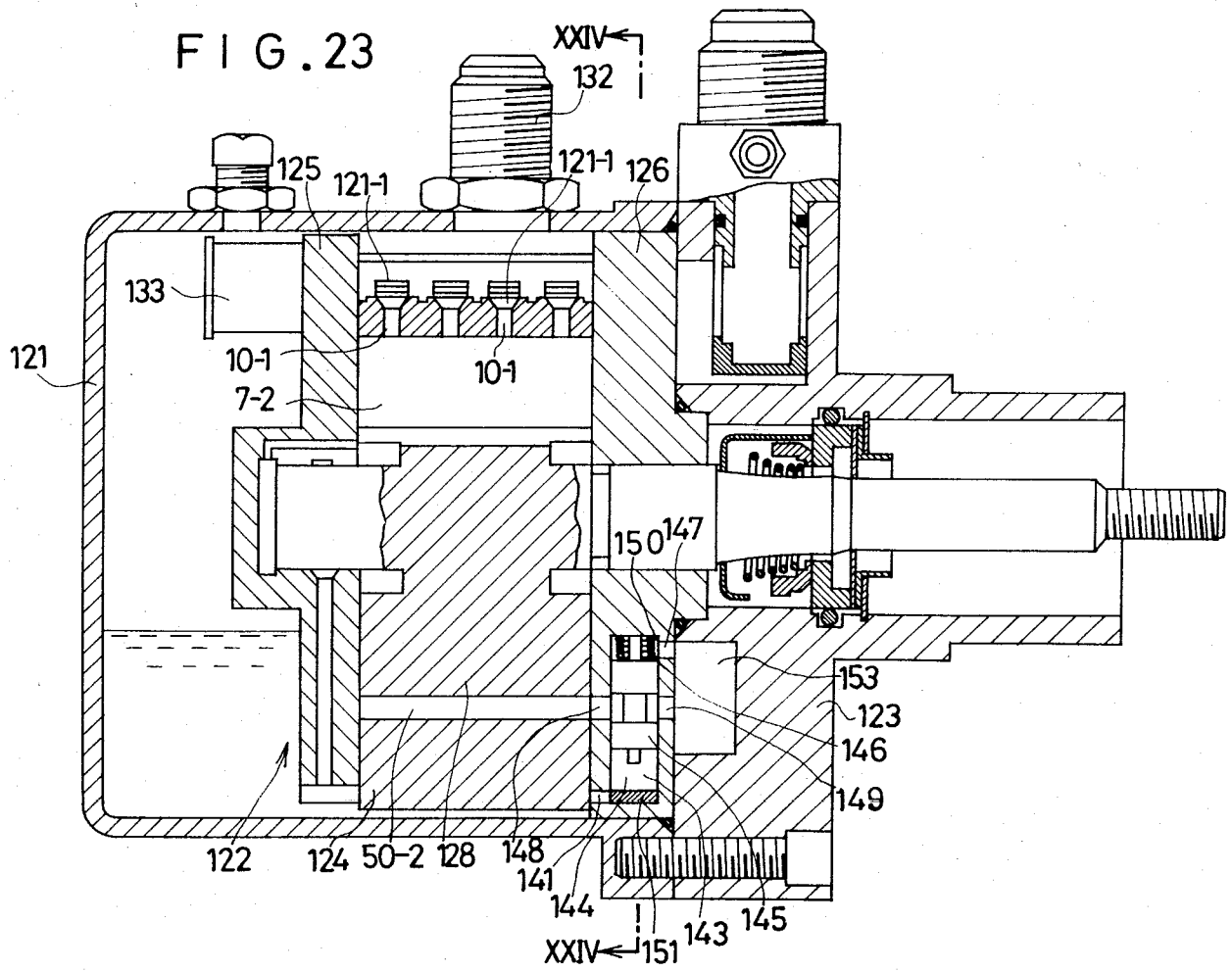
Figure 25:
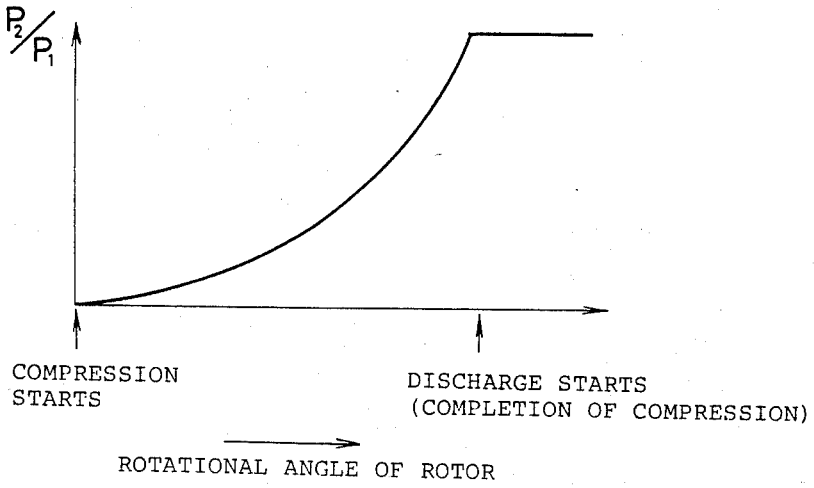
Figure 26A:
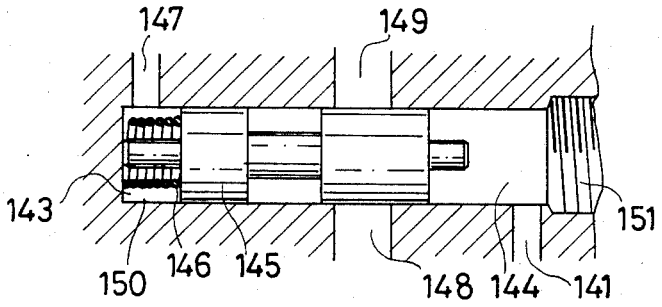
Figure 26B:
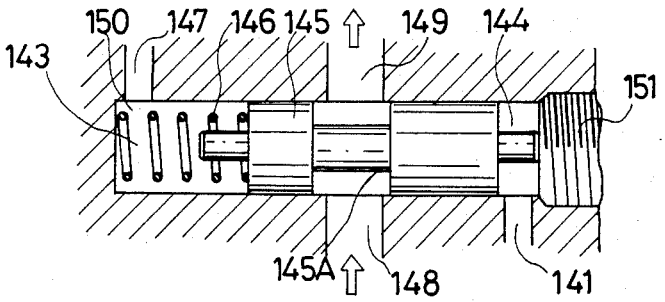
Figure 29:
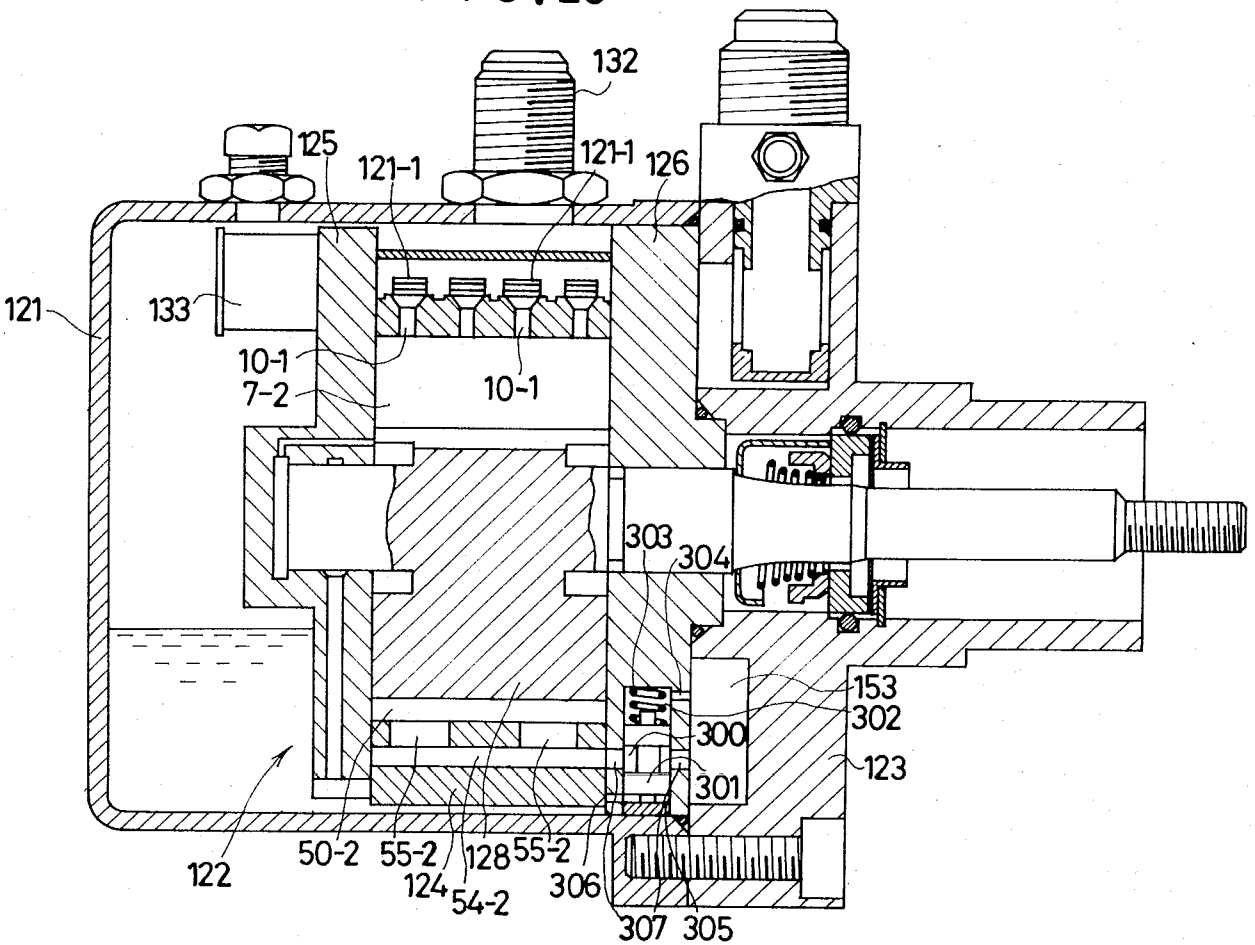

FIG. 15*a* is an enlarged sectional view showing the relative positional relation of various parts in the mode of full load operation;

FIG. 15*b* is a view similar to FIG. 15*a* in the mode of unload operation;

FIG. 15*c* is a graphic representation showing the relation between a spring force and a piston position;

FIG. 16 is a graphic representation showing the relation between suction pressure and a piston position;

FIG. 17 is a sectional view of Example 3;

FIG. 18*a* is a sectional view of a principal portion of Example 3 in the mode of unload operation;

FIG. 18*b* is a sectional view thereof in the mode of full load operation;

FIG. 19 is a graphic representation showing the $P_2/P_1$ and a rotational angle of a rotor;

FIG. 20 is a sectional view of Example 4;

FIG. 21 is a side sectional view of a conventional compressor based on the second inventive idea of the present invention;

FIG. 22 is a sectional view taken on line XXII—XXII of FIG. 21;

FIG. 23 is a side sectional view of Example 5 of the present invention;

FIG. 24 is a sectional view taken on line XXIV—XXIV of FIG. 23;

FIG. 25 is a characteristic view showing the relation between the $P_2/P_1$ and a rotational angle of a rotor;

FIGS. 26*a* and 26*b* are sectional views showing positions of the unloader piston respectively in the full load and unload conditions;

FIGS. 27 and 27*a* are sectional views of Example 6 of the unloader;

FIG. 28 is a sectional view of Example 7 of the compressor corresponding to that of FIG. 22; and FIG. 29 is a side sectional view of Example 8 of the compressor.

Figure 1:
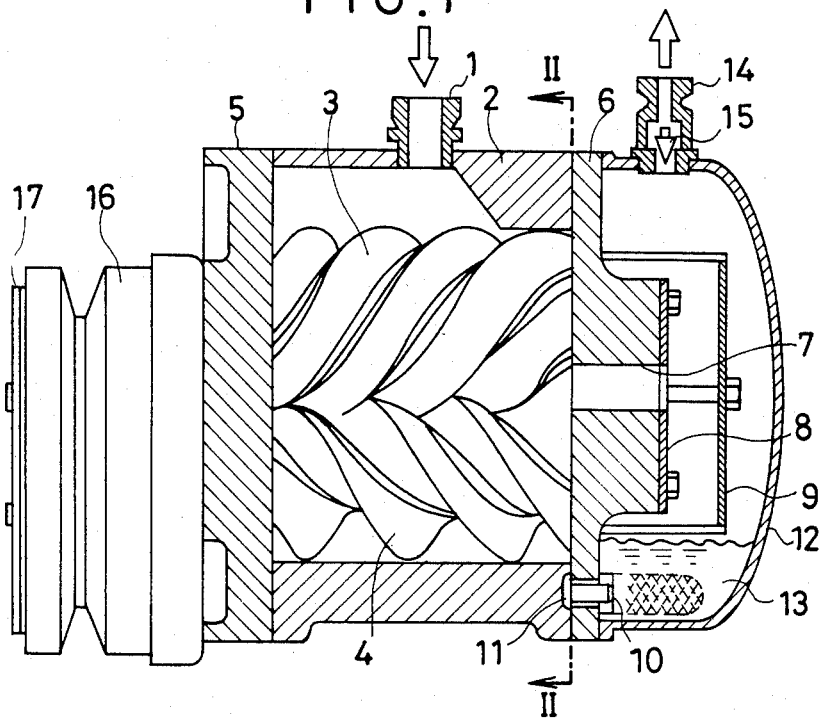
FIG. 1 is a sectional view of a conventional capability control apparatus for a vehicular freezing and air-conditioning apparatus.

Referring now to FIGS. 1 through 4, the conventional device is schematically illustrated. In FIG. 1, the device comprises a suction fitting 1, a rotor casing 2, a male rotor 3, a female rotor 4, a front casing 5, a rear casing 6, a discharge port 7, a bearing cover 8, an oil separator element 9, an oil injection orifice 10, an injection groove 11, an injection hole 11-1 (FIG. 2), an oil separator housing 12, oil 13, a discharge fitting 14, a discharge check valve 15, a rotor 16 of a magnetic clutch, and a friction plate 17 of the magnetic clutch.

Figure 2:
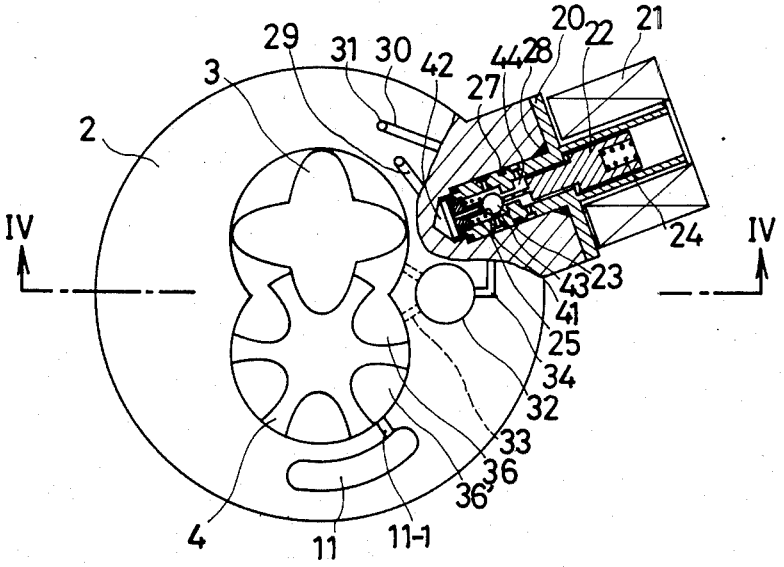
FIG. 2 is a sectional view taken on line II—II of FIG. 1.
Figure 3:
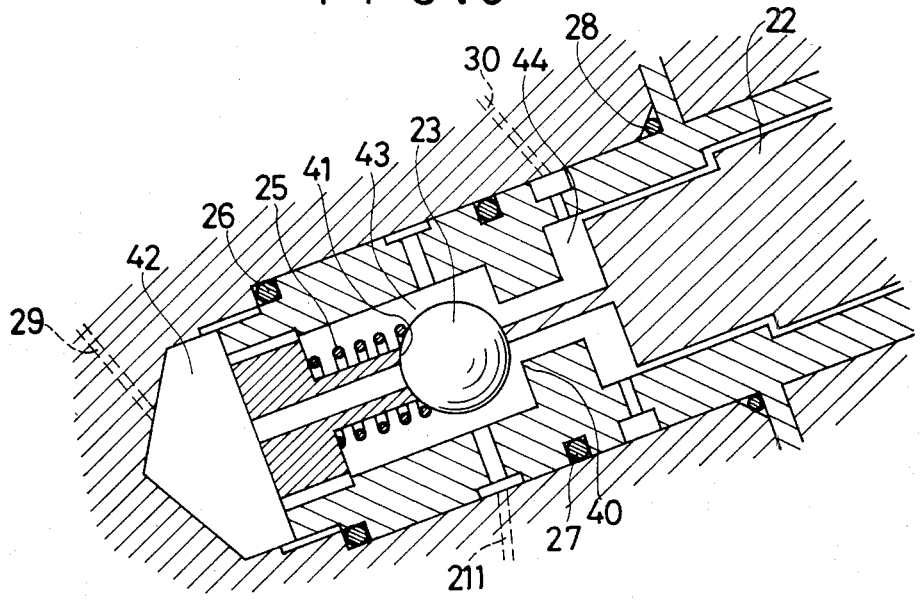
FIG. 3 is an enlarged view showing a principal portion of FIG. 2.
Figure 4:
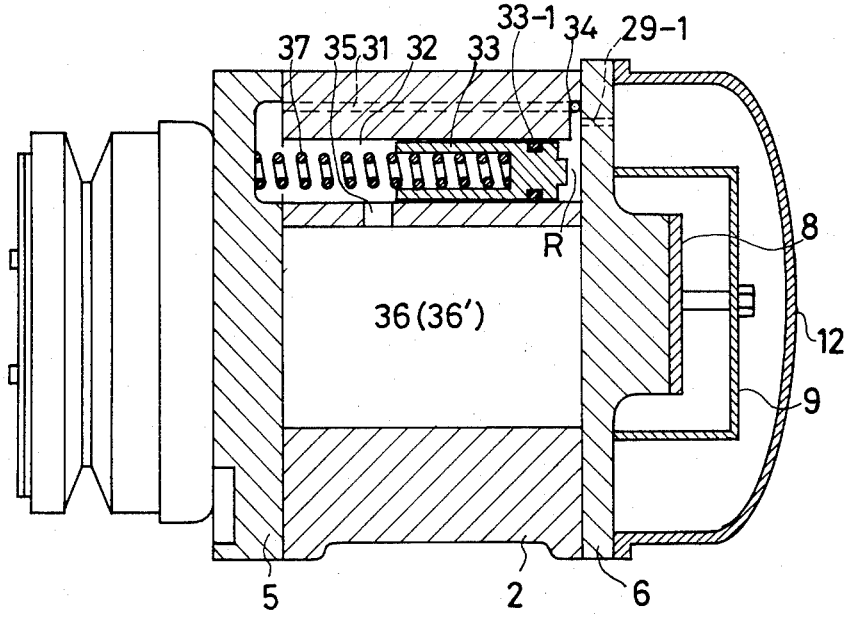
FIG. 4 is a sectional view taken on line IV—IV of FIG. 2.

FIG. 2 is a sectional view taken on line II—II of FIG. 1, FIG. 3 is an enlarged view of a principal portion thereof, and FIG. 4 is a sectional view taken on line IV—IV of FIG. 2. In these figures, reference numeral 20 designates a magnetic valve assembly mounted on the rotor casing 2; 21, a magnetic coil; 22, a magnetic valve piston; 23, a ball; 24, 25, springs; 26, 27, 28, O rings; 29, a high pressure groove formed in the end of the rotor casing 2 to introduce high pressure gas within the oil separator housing 12 into a high pressure chamber 42 of the magnetic valve 20; 29-1, a high pressure hole extending through the rear casing 6 for the same purpose as described above; 30 and 31, a low pressure groove and a low pressure hole, respectively, formed in the rotor casing 2 to introduce low pressure gas into a low pressure chamber 44 of the magnetic valve 20; 32, a hole for an unloader piston formed in the rotor casing 2; 33, an unloader piston; 33-1, an O-ring disposed on the unloader piston; 34, an actuating pressure groove for connecting the hole 32 for the unloader piston with an actuating pressure chamber 43 of the magnetic valve 20; 35, a bypass hole for connecting the hole 32 for the unloader piston with a compression chamber 36; 37, a spring; 36 and 36′, compression chambers composed of the rotor casing 2, the rear casing 6, the male rotor 3 and the female rotor 4. Further, reference numerals 40, 41 designate seat portions upon which the ball 23 impinges; 42, a high pressure chamber of the magnetic valve 20; 43, an actuating pressure chamber of the magnetic valve 20; and 44, a low pressure chamber of the magnetic valve 20.

Now operation of the above-described compressor will be explained: In FIG. 1, the rotor 16 of the magnetic clutch is rotated by means of a belt (not shown), and the clutch is energized so that the friction plate 17 may be attracted towards the rotor 16 to rotate the female rotor 4 directly connected to the friction plate 17. The male rotor 3 follows the rotation of the female rotor 4, and a closed volume of the compression chambers 36, 36′ composed of the female rotor 4, the male rotor 3, the rotor casing 2 and the rear casing 6 is reduced by the rotation of the rotors 4 and 3, so that gases within the compression chambers 36 and 36′ are compressed. On the other hand, a low pressure gas is sucked into the compression chambers 36 and 36′ from the suction fitting 1. The compressed high pressure gas passes through the discharge port 7, the gas being separated from oil by the separator element 9, and thereafter only the gas is discharged from the discharge fitting 14 to the outside of the compressor. On the other hand, the lubricating oil 13 separated from the discharge gas by the separator element 9 stays at the lower part of the separator housing 12 and is injected into the compression chamber 36′ through the injection groove 11 and the injection hole 11-1 from the oil injection orifice 10 for the purposes of achieving lubrication and reducing a gas leakage from the closed volume of the compression chamber 36.

When the magnetic coil 21 of the magnetic valve 20 has been energized, the piston 22 is urged towards the coil 21 and the ball 23 is biased upward by means of the spring 25 with the result that the ball is moved from the seat portion 41 and bears on the seat portion 40 to separate the actuating pressure chamber 43 from the low pressure chamber 44. Then, the high pressure gas within the oil separator 12 is introduced into the high pressure chamber 42 of the magnetic valve 20 from the high pressure hole 29-1 of the rear casing 6 as shown in FIG. 4 and from the high pressure groove 29 of the rotor casing 2 as shown in FIG. 3. The high pressure gas is further transmitted (not shown) from the high pressure chamber 42 of the magnetic valve 20 to the actuating pressure groove 34 of the rotor casing 2 through the actuating pressure chamber 43 to act on the right end R of the unloader piston 33 to force the piston 33 leftwards as viewed in the drawing. As a result, the piston 33 blocks the bypass hole 35 formed in the rotor casing 2, and the closed volume of the compression chambers 36, 36′ repeats normal suction and compression strokes (full load operation). On the other hand, when the magnetic coil 21 has been deenergized, the piston 22 is pushed out by means of the spring 24 and the ball 23 is pressed by the tip of the piston 22 and is moved from the seat portion 40 to bear on the seat portion 41 with the result that the actuating pressure chamber 43 comes into communication with the low pressure chamber 44 and is separated from the high pressure chamber 42. At the same time, the low pressure gas introduced from the gas inlet to the low pressure chamber 44 of the magnetic valve through the low pressure hole 31 and low pressure groove 30 formed in the rotor casing 2 is introduced into the actuating pressure chamber 43. Since the suction gas (not shown) is exerted on the right end R of the unloader piston 33 from the actuating pressure chamber 43 through the actuating pressure groove 34, both the ends of the unloader piston 33 assume a low pressure level and the piston 33 having blocked the bypass hole 35 is forced back rightwards as viewed in FIG. 4 by means of the spring 37 with the result that the hole 32 for the unloader piston is brought into communication with the compression chamber 36 through the bypass hole 35. In the drawing, reference numeral 211 designates a hole.

The gas, which is to be compressed while the aforesaid male rotor 3 and female rotor 4 rotate, is discharged towards the suction side (not shown) from the compression chamber 36 via the bypass hole 35 and the hole 32 for the piston, note of FIG. 4, to a certain position determined by the right end position of the bypass hole 35, and therefore, a swept volume of the compressor decreases, thus taking the mode of unload or partial load operation.

Turning on and off energization of the magnetic coil 21 may be achieved by suitably selecting signals of the number of revolutions of the compressor, the evaporative pressure (low pressure) of refrigerant, high pressure or the like.

The prior art as described above, in which the magnetic valve 20 is used to switch the mode of operation between the unload or partial load and the full load, has been suffered from significant disadvantages as noted above.

In the following, several embodiments of the present invention will be described with reference to the accompanying drawings.

EXAMPLE 1 (See FIG. 5–FIG. 12)

In the present embodiment, reference numeral 50 designates an in-cylinder pressure transmission groove for connecting the hole 32 for the unloader piston with a compression chamber 51 on the end surface of the rotor casing 2; 35, a bypass hole for bringing the hole 32 for the unloader piston into communication with the compression chamber 51; and 52, a spring having a spring constant K. The unloader piston 33 is on its low pressure side in communication with a suction opening, and has its high pressure side to which there is applied an in-cylinder pressure of the compression chamber 51 prior to opening of a discharge port through the in-cylinder pressure transmission groove 50, and to which there is applied a spring force by means of a spring 52.

In the compressor of this type, when the male rotor 3 and female rotor 4 are rotated so that the helical protuberance of the male rotor 3 and the helical groove of the female rotor 4 may come into engagement with each other, these members, the inner surface of the rotor casing 2, the inner surface of the front casing 5 and the inner surface of the rear casing 6 constitute closed compression chambers. The volume of these compression chambers decreases as the rotors 3 and 4 rotate.

Considering now an arbitrary one of these compressors, when the compressor is at a level of maximum volume, it is in communication with the suction opening, and when the rotors rotate through a certain angle and the compression chamber is isolated from the suction opening, the gas being so far sucked within the compressor chamber is compressed as the volume of the compressor decreases as a result of the rotation of both the rotors. When both the rotors rotate through a certain angle, the compression chamber is open to the discharge port so that the compressed gas within the compression chamber may be discharged through the discharge port. Simultaneously with completion of discharge, the volume of the compression chamber assumes zero and this chamber becomes perished while the helical groove of each rotor immediately comes into communication with the suction opening.

At the full load, the compression chamber is isolated from the suction opening when the former is at the level of the largest volume, whereas at the unload, when both the rotors are rotated through a certain angle with the result that the volume of the compression chamber decreases to some extent, the compression chamber is isolated from the suction opening, from which time the compression is started.

Figure 7:
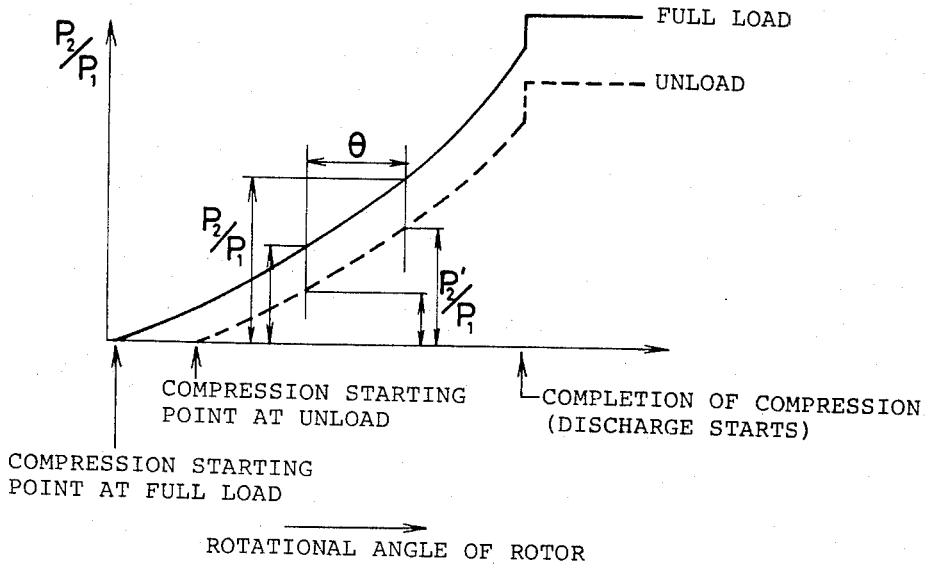
FIG. 7 is a graphic representation showing the relation between the $P_2/P_1$ of the compressor and a rotational angle of a rotor.

FIG. 7 is a schematic illustration of the relation $P_2/P_1$ between the in-cylinder pressure (the closed volume internal pressure) $P_2$ of the compressor and the inlet pressure $P_1$ and the rotational angle of the rotors. The screw compressor has, as is well known, the constitution that from the start of compression to the position of the rotational angle of the rotor determined depending on a configuration of the discharge port, compression is carried out, at which position the compressed gas within the cylinder rapidly comes into communication with the high pressure side gas. Since the compressor of this type is of the volume type, a ratio of the in-cylinder pressure $P_2$ to the suction pressure $P_1$ before the discharge port has been opened is given by the following formula. Even if the operating conditions should take any value of the suction pressure, the discharge pressure or the like of the compressor, the above-mentioned ratio from beginning to end of the compression will be obtained by multiplying ratio of the maximum compression chamber volume $V_{max}$ to the compression chamber volume V depending on the rotational angle of the rotor by the polytropic component $\kappa$.

$$PV = \text{constant} \tag{1}$$

$$\frac{P_2}{P_1} = \left(\frac{V_{max}}{v}\right)^{\kappa}$$

$$P_2 = \left(\frac{V_{max}}{v}\right)^{\kappa} \cdot P_1$$

where,

- $P_2$: in-cylinder pressure (pressure at a time when compression chamber volume is v at an arbitrary rotational angle of the rotor)
- $V_{max}$: maximum compression chamber volume
- v: compression chamber volume at an arbitrary rotational angle of the rotor
- $\kappa$: polytropic index
- $P_1$: suction pressure (in-cylinder pressure at maximum compression chamber volume—low pressure)

Figure 5:
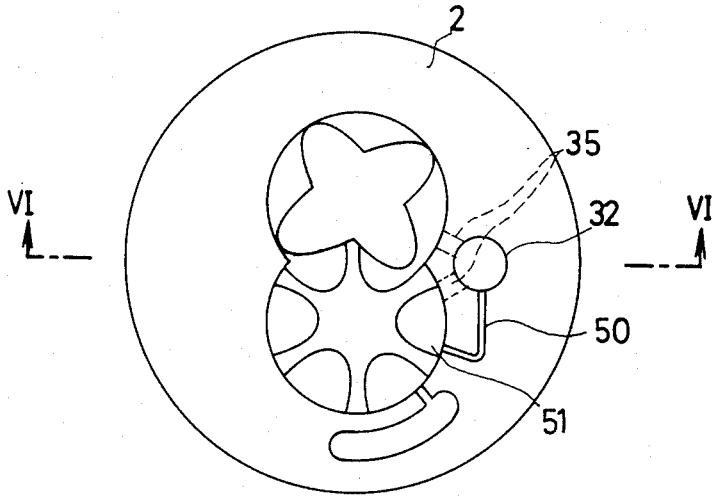
FIG. 5 is a sectional view of Example 1 in accordance with the present invention.
Figure 6:
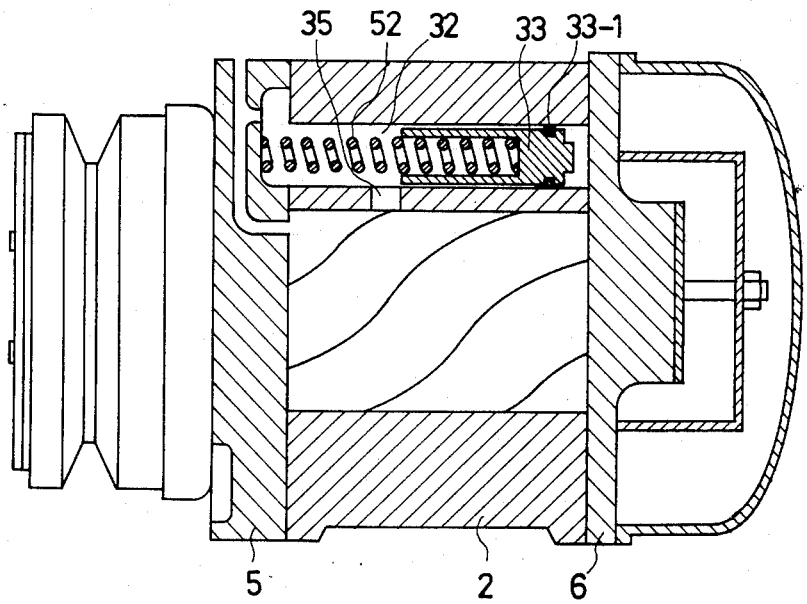
FIG. 6 is a sectional view taken on line VI—VI of FIG. 5.

The section, in which the in-cylinder pressure $P_2$ is applied to the right side on the high pressure side of the unloader piston 33 shown in FIGS. 5 and 6, is in the range of angle $\theta$ shown in FIG. 7 at the full load and at the unload or partial load.

The in-cylinder volume $= V_{max}$ at the compression starting point at the full load is different from that at the unload, thus, at the full load $\frac{P_2}{P_1}$ Solid line in FIG. 7 at the unload $\frac{P_2}{P_1}$ Broken line in FIG. 7 where, $P_2'$ is represented with the in-cylinder pressure at the unload, and $P_2/P_1$ and $P_2'/P_1$ do not at all rely on the operating conditions such as the low pressure, high pressure of the compressor or the number of revolutions of the rotors, and the like.

Here, as can be seen from FIG. 7, there is a relationship of $P_2/P_1 > P_2'/P_1$.

As shown in FIGS. 5 and 6, the in-cylinder pressure $P_2$ or $P_2'$ is applied to the high pressure side on the right side of the unloader piston 33 and the suction pressure $P_1$ applied to the low pressure side (left side) thereof, and the force of the spring 52 is applied, then the load acting on the piston 33 is as follows:

(1) Load caused by gas pressure (the force exerted on left as viewed in FIG. 6)

at the full load:

$$(P_2 - P_1)A = P_1A\left(\frac{P_2}{P_1} - 1\right) \quad (2)$$

at the unload:

$$(P_2' - P_1)A = P_1A\left(\frac{P_2'}{P_1} - 1\right) \quad (3)$$

where A: cross sectional area of the piston 33.

Figure 8:
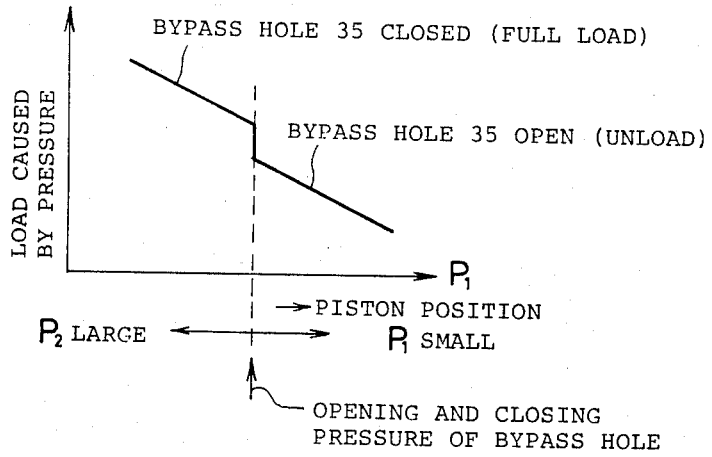
FIG. 8 is a graphic representation showing the relation between a load caused by pressure and the pressure.

As can be seen from the equations (2) and (3), the load caused by pressure has its characteristic that the smaller the suction pressure $P_1$ the smaller being the load caused by pressure, which is illustrated in FIG. 8.

From equation (1), $$\frac{P_2}{P_1} = \left(\frac{V_{max}}{v}\right)^{\kappa}$$

$$\therefore P_1A\left(\frac{P_2}{P_1} - 1\right) = P_1A\left\{\left(\frac{V_{max}}{v}\right)^{\kappa} - 1\right\}$$

(2) Load caused by spring

Figure 9:
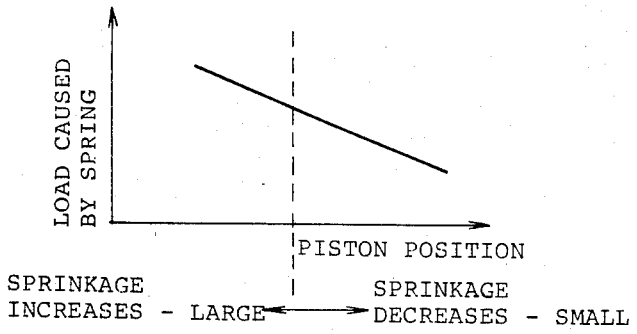
FIG. 9 is a graphic representation showing the relation between a load caused by a spring and an amount of shrinkage.

The relation between the spring load and the amount of spring shrinkage (the piston position) at a time when a linear spring 52 having a spring constant K is used is represented by the straight line as shown in FIG. 9.

Figure 10:
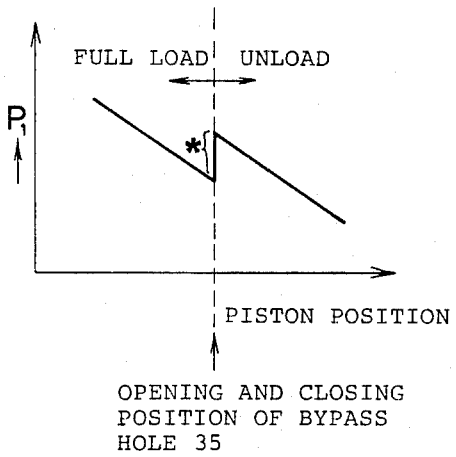
FIG. 10 is a graphic representation showing the relation between suction pressure and a piston position.

The aforementioned loads (1) and (2) are exerted on the unloader piston 33, and the piston 33 stops at a position where said loads are balanced. FIG. 10 shows the relation between the suction pressure $P_1$ and the position of the piston 33 in which FIG. 8 and FIG. 9 are combined.

When the suction pressure $P_1$ is at a high level, that is, on an absolute scale closer to zero pressure the piston 33 is positioned at left to assume the full load mode where the bypass hole 35 is closed by the piston 33. As the suction pressure $P_1$ is further decreased, or moves away from zero pressure, the piston 33 is moved rightwards. In other words, when there is increased suction action the piston 33 tends to move leftward in FIG. 6 and when the suction action decreases the piston tends to move rightward. At a position where the bypass hole 35 is opened by the left end of the piston 33 (FIG. 6), the gas load to the piston 33 caused by gas pressure is changed from the full load to the unload as shown by the solid line in FIG. 8. Accordingly, at a position where the bypass hole 35 is opened by the left end of the piston 33, the suction pressure $P_1$ will have the width as indicated by mark * in FIG. 10.

If the low suction pressure $P_1$ is further decreased when the bypass hole 35 is open, the piston 33 is moved rightwards. If the suction pressure $P_1$ increases, the mode will be reverse to that as described above. Thus, the balanced position of the piston caused by the suction pressure $P_1$ is indicated in FIG. 10.

Figure 11:
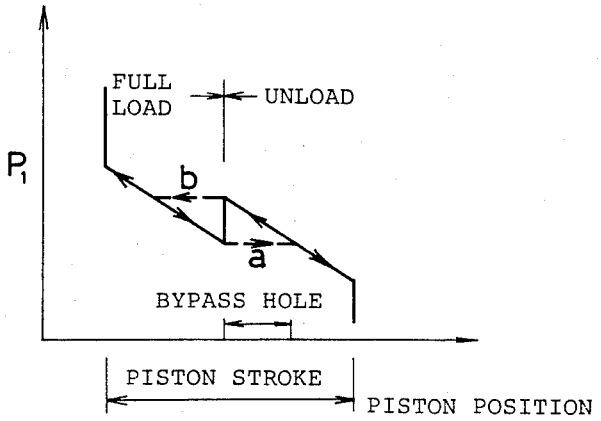
FIG. 11 is a further graphic representation showing the relation between suction pressure and a piston position.

While in the foregoing the in-cylinder pressure $P_2$ applied to the piston 33 assumes $P_2'$ simultaneously with opening of the bypass hole 35, it should be noted that practically, the conditions become as shown in FIG. 11 due to a slight time lag of change in pressure. When the low suction pressure $P_1$ gradually decreases under the full load condition, the piston 33 is moved rightwards and, at a position where the end of the piston 33 comes to the bypass hole 35, the operation will take the unload operation. The response by the force of spring 52 instantaneously occurs whereas the change in pressure from $P_2$ to $P_2'$ involves a slight lag. Thus, the piston 33, skips as indicated by a in FIG. 11. When the low suction pressure $P_1$ gradually increases under the unload operating condition, the piston 33 is moved leftwards and skips as indicated by b for the reason similar to that as described above.

It should be understood that for the sake of simplicity, the frictional force of the O-ring 33-1 disposed on the unloader piston 33 in FIG. 6 has not been taken into consideration. If the frictional force F of the O-ring is taken into consideration, the equations (2) and (3) may be represented by at the full load:

$$P_1A\left(\frac{P_2}{P_1} - 1\right) \pm F \quad (2)'$$

at the unload:

$$P_1A\left(\frac{P_2'}{P_1} - 1\right) \pm F \quad (3)'$$

In the above-described formulae, the frictional force F, which acts reversely to the moving direction of the piston 33, is the force for impeding the movement of the piston 33, the direction of which force changes according to the gas pressures ($P_2$, $P_2'$, $P_1$) applied to the piston 33 and the magnitude of the force of the spring 52.

It will be understood from FIG. 7 that if the in-cylinder pressure $P_2$ or $P_2'$ acting on the right side of the piston 33 has a certain width, the frictional force F acts so as to impede the movement of the piston 33. That is, the variable pressure components of $P_2$ and $P_2'$ are offset by the frictional force F of the piston 33, and the piston 33 is not moved in proportion to the magnitude of $P_2$ and $P_2'$ which vary.

As described above, according to the present embodiment, it is possible to automatically switch the mode of operation from full load to unload or vice versa in compliance with the magnitude of suction pressure of the compressor instead of signals or the like from outside.

In this manner, the switch of the operating mode from full load to unload or vice versa may be accomplished automatically by the simple device, thereby offering the following advantages:

(1) A magnetic valve heretofore used need not be provided, this greatly reducing the cost.

(2) The switch of the operating mode from full load to unload and vice versa is accomplished by making use of change in magnitude of low pressure, whereby:

(a) At the time of low speed, the mode of full load is taken, and at the time of high speed, the mode of unload or partial load is taken. That is, the rotary type compressor has a tendency to increase air-conditioning capability at the time of high speed as previously mentioned and in consequence consumes power more than needed, but at the time of high speed, low pressure is lowered to take the mode of unload, thus saving power.

(b) When loads in compartments of an air-conditioner are small as in the spring and fall or in the winter season, the suction pressure decreases and thus the refrigerant compressor takes the mode of unload operation to prevent useless consumption of power.

(3) In the unloader having the present construction, the size of the compressor need not be increased, and the mounting limitation of the compressor is the same as the case where unloader is not present.

While in the above-described embodiment an example is shown in which the rate of unload is relatively small, it should be noted that if the rate of unload or partial load (full load/unload) increases, there occurs an inconvenience in case that a single linear spring 52 is employed.

Figure 12:
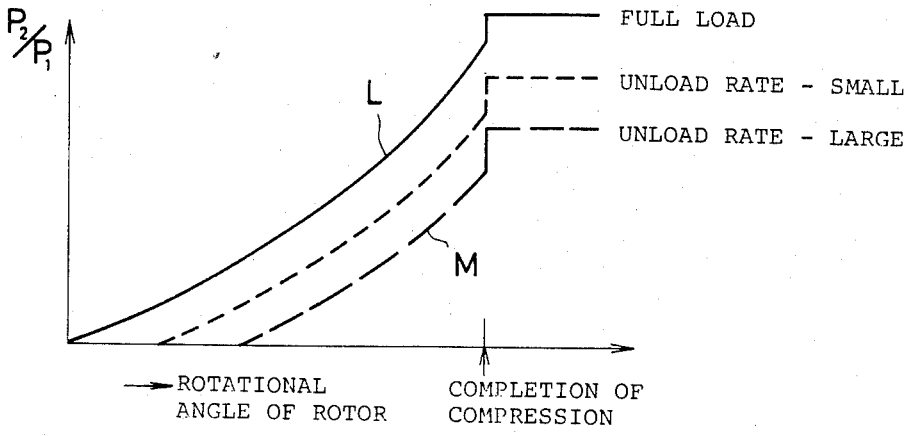
FIG. 12 is a graphic representation showing the relation between the $P_2/P_1$ and a rotational angle of a rotor.

FIG. 12 shows the relation between $P_2/P_1$ and the rotational angle of the rotor in case of full load, in case that the rate of unload is relatively small, and in case that the rate of full load is relatively large.

EXAMPLE 2 (See FIG. 13–FIG. 16)

Figure 13:
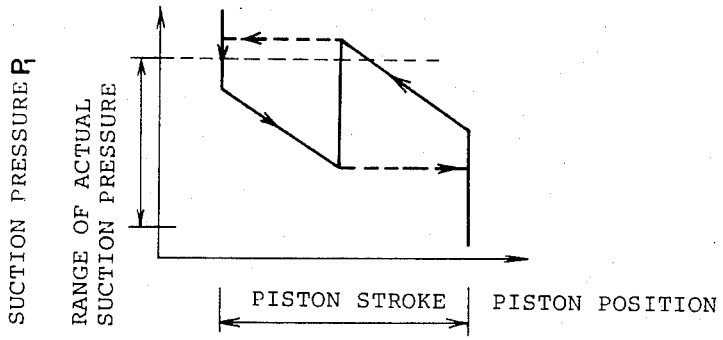
FIG. 13 is a graphic representation showing the relation between suction pressure and a piston position.

In case that the rate of unload is relatively large, the force of gas pressure applied to the piston 33 is greatly different between the modes at the full load and at the unload, and therefore, the relation of suction pressure $P_1$ to the position of unloader piston is as shown in FIG. 13. With this, there occurs a case wherein the switch of the operating mode from unload to full load can be accomplished only by higher value of suction pressure than the range of variation in low suction pressure $P_1$ for practical use. That is, there occurs a case wherein an inconvenience is involved in which once an entry into unload mode is substantially made, it cannot be returned to the full load.

Figure 14:
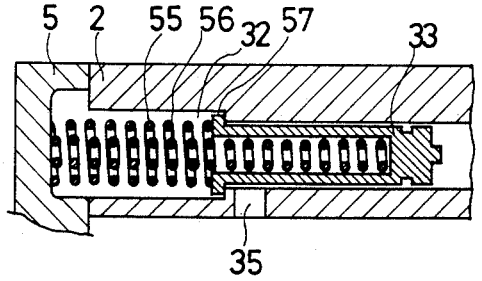
FIG. 14 is a fragmentary sectional view of Example 2.

In such a case, a construction in Example 2 shown in FIG. 14 is employed. That is, in FIG. 14, reference numeral 56 designates a spring A having a spring constant $R_1$; 55, a spring having a spring constant $R_2$, and 57, a floating stopper.

FIG. 15*a* shows, in the full load condition, the relative positional relation between the spring A 56, the spring B 55, the floating stopper 57 and the bypass hole 35. FIG. 15*b* shows, in the unload condition, the relative positional relation similar to FIG. 15*a*. FIG. 15*c* shows the relation between the spring force and the piston position.

In the full load condition in which the piston 33 blocks the bypass hole 35 as shown in FIG. 15*a*, the floating stopper 57 is seated on the piston 33, and the combined force of the spring A 56 and spring B 55 (spring constant $K=R_1+R_2$) is exerted on the piston 33. This force is in proportion to the position of the piston 33. When the piston 33 is moved rightwards and comes to the bypass hole 35, the floating stopper 57 is set so as to bear on the corner of the hose 32 for piston. Accordingly, if the piston 33 is positioned rightwards of said position, the only spring force of the spring A 56 is exerted on the piston 33.

FIG. 15*b* reveals an example in which the piston 33 is at the right side of the bypass hole 35, showing the unload condition wherein the bypass hole 35 causes a communication between the compression chamber and the suction side.

FIG. 15*c* is a view explaining the spring force applied to the piston 33 as previously mentioned. As may be understood from the foregoing description, the spring force will skip at a portion where the floating stopper 57 bears on the corner portion of the piston hole.

According to the arrangement as described above, in regard to the load applied to the piston 33, (a) as shown in FIG. 8, the force caused by the gas pressure skips at the full load and at the unload, and (b) as shown in FIG. 15*c*, the spring force skips in the mode from full load to unload or from unload to full load, and thus, the position of the piston 33 is determined by the balance therebetween, there is hence eliminated an inconvenience that once an entry into unload operation is made in the range of suction pressure for practical use, it cannot be returned to the full load mode. It is noted that if the force caused by the gas pressure and the force caused by the spring are ideally caused to balance, the relation between the suction pressure $P_1$ and the position of the piston 33 is indicated by the straight line (FIG. 16).

Further, in the present Example 2, at the position where the left end of the piston 33 comes to the bypass hole 35 (the position where the bypass hole 35 starts to open), the floating stopper 57 bears on the corner of the piston hole, but in the condition in which the piston 33 partly blocks the bypass 35, the $P_2/P_1$ stands between the solid line L and the long broken line M in FIG. 12. Therefore, the position at which the floating stopper 57 bears may be suitably determined between the position at which the piston 33 totally closes the bypass hole 35 and the position at which the piston totally opens the bypass hole.

EXAMPLE 3 (See FIGS. 17–19)

A further preferred embodiment is shown in FIG. 17. FIG. 17 corresponds to FIG. 5. Like elements in the first embodiment shown in FIG. 4 bear like numerals.

In FIG. 17, reference numeral 60 designates a pressure transmission groove formed in the end of the rotor casing 2 for connecting the injection groove 11 with the right end of the hole 32 for the unloader piston, and 61 designates a volume for attenuation of variation in pressure provided in the midst of said pressure transmission groove 60. In a manner similar to the prior art, oil 13 stayed at the lower portion of the oil separator housing 12 is reduced in pressure by the oil injection orifice 10 and introduced into the injection groove 11, and the oil is injected into the compression chamber through the injection hole 11-1.

As described above, the injection oil pressure is applied to the right end R of the hole 32 for piston, and the O-ring 33-1 disposed on the piston 33 is removed (not shown). The oil pressure within the injection groove 11 increases or decreases in response to an increase or decrease in in-cylinder pressure since the groove 11 is in communication with the interior of the cylinder through the hole 11-1. The ratio $P_3/P_1$ or $P_3'/P_1$ of the injection pressure $P_3$ introduced to the right of the piston 33 at the full load or $P_3'$ (at the unload) to the inlet pressure $P_1$ is ideally a constant value similarly to $P_2/P_1$=constant or $P_2'/P_1$=constant of the first embodiment. Actually, however, such a ratio takes the following forms due to the injection hole 11-1 and a channel resistance between the injection hole 11-1 and the injection orifice 10:

$$\text{At the full load: } \frac{P_3}{P_1} = \alpha \frac{HP}{P_1} + \beta$$

$$\text{At the unload: } \frac{P_3'}{P_1} = \alpha' \frac{HP}{P_1} + \beta'$$

where, $P_3$, $P_3'$: oil pressure (injection pressure) applied to the right side of the piston 33

$P_1$: low-pressure gas pressure applied to the left side of the piston 33

HP: discharge gas pressure of compressor $\alpha$, $\beta$, $\alpha'$, $\beta'$: constant That is, $P_2/P_1$ or $P_2'/P_1$ shown in the first embodiment is constant irrespective of the operating conditions of the compressor, whereas $P_3/P_1$ or $P_3'/P_1$ in this second embodiment depends on the ratio of the operating pressure $HP/P_1$ of the compressor but actually the coefficient $\alpha$ or $\alpha'$ is a relatively small value. Accordingly, $P_2/P_1$, $P_2'/P_1$ in the formulae (1) and (2) shown in the first embodiment are replaced by $P_3/P_1$, $P_3/P_1$ slightly depending on the ratio of operating pressure to determine particulars of the spring 52 from the operating conditions in switching the operating mode from full load to unload or from unload to full load as desired in the actual freezing and air conditioning systems, then the operation may be carried out in a manner similar to the first embodiment.

Since in the case of this construction oil pressure is applied to the right side of the piston 33, the O-ring 33-1 of the piston 33 as shown in FIG. 6 need not be provided, which thus results in a lower cost. In addition, in this construction, the piston 33 has an extremely small frictional force, chattering of the piston 33 sometimes occurs due to variations in pressure of $P_3$, $P_3'$ or the like, and therefore, it is desired that the variation in pressure be decreased at the volume 61.

While in the above-described Example 3 the in-cylinder pressure prior to opening of the discharge port is directly applied to the right side (the high pressure side) of the unloader piston 33 of the compressor, it will of course be understood that separately from the unloader piston of the compressor, an actuating piston may be provided a position of which is determined in relation to the in-cylinder pressure prior to opening a low pressure and discharge port and the force of spring, as shown in FIGS. 18*a* and 18*b*, and which can automatically switch the actuating pressure applied to the unloader piston 33 by the value of low pressure of the compressor. That is, in the construction of the unloader piston of the compressor, low pressure and actuating pressure are introduced respectively into the low pressure side and the high pressure side of the piston of the unloader with a magnetic valve in the prior art shown in FIGS. 1–3, and in place of the magnetic valve, the actuating piston having such a constitution as in the example is provided, separately from the unloader piston of the compressor, into which both ends there are introduced the low pressure and the in-cylinder pressure prior to opening the discharge ports and a position of which is determined in relation to the spring force and the force of low pressure and in-cylindrical pressure. Low pressure and high pressure of the compressor are further introduced into the actuating piston, and either low or high pressure introduced from the compressor to the actuating piston is directed to an actuating pressure circuit of the unloader piston of the compressor according to the position of the actuating piston which is determined in relation to the spring force, and the force of low pressure and in-cylinder pressure.

FIGS. 18*a* and 18*b* show the embodiments of the above-described construction, FIG. 18*a* being in the mode of unload and FIG. 18*b* being in the mode of full load. Pressure transmission paths are indicated by the broken lines. Also in these drawings, like members in FIG. 3 bear like reference numerals.

In FIGS. 18*a* and 18*b*, reference numeral 101 designates an actuating piston disposed separately from the unloader piston 33; 102, an actuating piston casing; 103, a piston; 104, a high pressure hole formed in the piston 103; 105, a low pressure hole formed in the piston 103; 106, a spring; and 109 and 111, low pressure introducing holes formed in the actuating piston casing 102, said holes being connected to the low pressure side of the compressor.

A high pressure introducing hole, which is indicated with 110 and formed in the actuating piston casing 102, is connected to the high pressure side of the compressor.

An actuating pressure transmission hole, which is indicated with 112 and formed in the actuating piston casing 102, is connected to the high pressure side (the right side) of the unloader piston 33.

An in-cylinder pressure introducing hole, which is indicated with 113 and formed in the actuating piston casing 102, is connected to a suitable compression chamber of the compressor.

The operation and effects therefor are the same as those in the previously mentioned embodiments.

That is, when the suction pressure (low pressure) of the compressor is low, the piston 103 is moved rightwards (FIG. 18*a*), the low pressure is applied to the actuating pressure transmission hole 112 from the low pressure introducing hole 111 through the low pressure hole 105, and also the low pressure is applied to the right end of the unloader piston. Thus, the low pressure is applied to both the ends of the unloader piston 33, which is moved rightwards by the force of the spring 37 to open the bypass hole 35, thus taking the mode of unload operation. Conversely, in the case that the suction pressure is high (FIG. 18*b*), the high pressure is applied to the actuating pressure hole 112 from the high pressure introducing hole 110 through the high pressure hole 104, and also the high pressure is applied to the right end of the unloader piston 33. Accordingly, the unloader piston 33 is moved leftwards against the spring force, and the bypass hole 35 is closed by the unloader piston 33, thus taking the mode of full load operation (the compressor side is not shown in FIG. 18*b*).

While in the above-described embodiment, an example of the screw compressor has been illustrated, it should be noted that the present invention may be likewise applied to the compressor of the type which is provided with a discharge valve. In the case of the compressor with a discharge valve, the discharge starting position varies with the ratio of pressure at which the compressor is driven as shown in FIG. 19, but the in-cylinder pressure applied to the unloader piston may be suitably determined at the rotor position at the pressure ratio less than the ratio of operating pressure encountered when the compressor is provided in the freezing and air conditioner system. The conceptional view therefor is shown in FIG. 20 as Example 4.

EXAMPLE 4

(See FIG. 20)

FIG. 20 shows the embodiment in the case of the rotary compressor which is provided with a discharge valve 201.

In FIG. 20, reference numeral 202 designates an unloader piston, and 203 designates an in-cylinder pressure transmission path. The operation and effects therefore are the same as those of the above-described embodiments.

In the next place, a second inventive idea of the present invention will be described with reference to the prior art and the embodiment of the present invention.

FIGS. 21 and 22 schematically show the prior art devices. This prior art compressor comprises a housing 121 opened at one end, a compressor assembly 122 within the housing 121, and a front casing 123 for sealing an open surface of the housing 121. The compressor assembly 122 is provided with a rotor casing 124 having a substantially elliptical inner peripheral surface and a substantially cylindrical outer periperal surface, a front side block 126 and a rear side block 125 which are mounted on front and rear ends thereof, and two semi-circular cylinder chambers 50-1 and 50-2 independently separated by a cylindrical rotor 128. The rotor 128 includes vanes 7-1, 7-2, 7-3 and 7-4 capable of being moved to and from the cylinder chambers 50-1 and 50-2, and the rotor 128 is supported rotatably on the front side block 126 and the rear side block 125.

The semi-circular cylinder chambers 50-1 and 50-2 are further divided by said vanes 7-1, 7-2, 7-3 and 7-4 into small chambers 51-1, 51-2, 51-3 and 51-4, volumes of which are gradually increased and decreased by rotation of the rotor 128 in order to suck and compress a refrigerant gas. The refrigerant gas delivered into the suction fitting 152 by an evaporator or the like not shown passes through the suction chamber 153 within the front casing 123 and is separated into two suction passages 54-1 and 54-2 disposed in the front side block 126 and the rotor casing 124, and the gas is thence supplied to two cylinder chambers 50-1 and 50-2 through suction ports 55-1 and 55-2 formed in two cylinder chambers 50-1 and 50-2, respectively. The small chambers 51-1, 51-2, 51-3 and 51-4 formed by dividing the cylinder chambers 50-1 and 50-2 by the vanes 7-1, 7-2, 7-3 and 7-4 suck the refrigerant gas from the suction ports 55-1 and 55-2 when the volume of the former increases by rotation of the rotor or compress the refrigerant gas as said volume decreases, and the discharge valves 121-1 and 121-2 are raised from the discharge ports 10-1 and 10-2 to discharge the gas from the cylinder chambers 50-1 and 50-2. The high pressure refrigerant gas having discharged from the cylinder chambers 50-1 and 50-2 passes through an oil separator 133 disposed on the rear side block 125, where the refrigerant gas is separated from oil, and the high pressure refrigerant gas is delivered from the discharge fitting 132 to the compressure or the like (not shown) outside the compressor.

In the above-described capability control method for vehicular air-conditioning and refrigerating apparatus which uses a compressor for suction and compression of a refrigerant to air-condition and freeze the inside of a vehicle or a freezer, the number of revolutions of the compressor driven by the engine increases particularly when the vehicle runs at a high speed to thereby increase the capability of the compressor more than needed, which leads to a decrease in suction pressure of the compressor and an increase in discharge pressure with the result that the compressor sometimes stops its operation due to growth of frost on the evaporator and the actuation of high pressure protective device. In addition, the capability more than needed is produced to increase power consumption of the compressor, which disadvantageously leads to the lowering of vehicle speed.

It is an object of the present invention to provide a compressor having a capability control function which can remove the above-mentioned disadvantages and can better operate by means of a simple structure.

EXAMPLE 5

(See FIG. 23–FIG. 26*b*)

FIG. 23 corresponds to FIG. 21 which shows the prior art. FIG. 24 is a sectional view taken on line XXIV—XXIV of FIG. 23.

The same members as those of the prior art bear like reference numerals. In FIG. 24, the phantom outlines of 98, 99 respectively designate the circle of the outer periphery of the rotor 128 and the substantial ellipse of the inner periphery of the rotor casing 124.

Reference numeral 141 designates an in-cylinder pressure transmission groove formed on the end on the side of the rotor casing 124 of the front side block 126, and the front side block 126 and the rotor casing 124 constitute a closed passage. Reference numeral 142 designates an in-cylinder pressure detection hole of the first cylinder chamber 50-1 formed in the front side block 126 in communication with the first semi-circular cylinder chamber 50-1, the in-cylinder pressure transmission groove 141 being connected to the in-cylinder pressure detection hole 142 and having the other end brought into communication the in-cylinder pressure side 144 of the unloader piston chamber 143. The unloader piston chamber 143 accommodates slidably therein a piston 145 and a spring 146 having a spring constant K. Reference numeral 147 designates a low pressure detection hole, which is in communication with the suction chamber 153 disposed in the front side block 126, and through which the suction chamber 153 is brought into communication with the low pressure side 150 of the unloader piston chamber 143. Reference numeral 148 designates a bypass hole formed in the front side block 126, through which the second semi-circular cylinder chamber 50-2 is brought into communication with the unloader piston chamber 143. Reference numeral 149 designates an escape hole formed in the front side block 126, through which the unloader piston chamber 143 is brought into communication with the suction chamber 153. Reference numeral 151 designnates a cover adapted to close the unloader piston chamber 143.

As described above, the unloader piston chamber 143 is designed so that the in-cylinder pressure of the first cylinder chamber 50-1 is applied to the in-cylinder pressure side of the unloader piston 145, and the suction pressure of the compressor is applied to the low pressure side of the unloader piston 145 and at the same time the spring force of the spring 146 is applied thereto, and those portions in communication with neither of said in-cylinder pressure side of the unloader piston chamber 143 and the suction pressure side are provided with the bypass hole 148 in communication with the second cylinder chamber 50-2 and the escape hole 149 in communication with the suction chamber 153.

It should be noted that the position of the in-cylinder pressure detection hole 142 formed in the first semicircular cylinder chamber 50-1 is suitably determined lest that both the in-cylinder pressure detection hole 142 and a discharge port (not shown) the discharge valve of which is open should be in communication with each other, through small chambers (not shown) formed by dividing the cylinder chamber 50-1 by vanes (not shown) even under any condition of all ratios (discharge pressure/suction pressure) of operating pressure that the compressor encounters. Also, the position of the bypass hole 148 formed in the second semi-circular cylinder chamber 50-2 is suitably determined by the desired rate of unloader. Further, in case that the in-cylinder pressure detection hole 142 and the bypass hole 148 are formed in the end of the front side block 126, it is desirable that these holes have such a size as to be blocked by the rotating vanes. The shapes of the bypass hole 148 may be determined in a suitable shape, such as the circle, substantially ellipse, long ellipse or rectangular, and the number thereof may also be plural if necessary.

In this compressor, as has been discussed in connection with the prior art, when the rotor rotates, the volume of the small chambers formed by the rotor casing 124, the rotor 128, the vanes 7-1 - 7-4 and both the side blocks 125, 126 gradually increases, at this time if the suction port is in communication with the small chambers, the refrigerant gas is sucked, and when the suction port has been isolated from the small chambers (normally, the volume at this time assumes its maximum), the suction stroke is completed; and next, as the volume decreases, compression stroke takes place and then the small chambers come into communication with the discharge ports 10-1 and 10-2. When the pressure of the small chamber increases as a result of reduction in volume, the discharge valves 121-1 and 121-2 of the discharge ports are pushed up to discharge low temperature gas from the small chambers. Since two independent cylinder chambers are provided, therein, these strokes are independently accomplished in two cylinder chambers.

Let $P_2$ represent the pressure within the small chamber (which is referred to as the in-cylinder pressure) and $P_1$ represents the suction pressure of the compressor (the pressure of the suction chamber 153) then the relation between $P_2/P_1$ and the rotational angle of the rotor is schematically illustrated in FIG. 25.

Since this compressor is of the so-called volume type, the ratio between the in-cylinder pressure $P_2$ and the suction pressure $P_1$ from the start of compression to the completion thereof is given by the following formula. Even if the operating conditions take any value of the suction pressure, the discharge pressure or the like of the compressor, the above-mentioned ratio from beginning to end of the compression will be obtained by multiplying a ratio of the volume V at the time of completion of suction to the compression chamber volume v depending on the rotational angle of the rotor by the polytropic component κ.

$$PV^{\kappa} = \text{constant} \tag{4}$$

$$\frac{P_2}{P_1} = \left(\frac{V}{v}\right)^{\kappa}$$

$$P_2 = \left(\frac{V}{v}\right)^{\kappa} \cdot P_1$$

where, $P_2$: in-cylinder pressure (pressure at a time when small chamber volume is v at an arbitrary rotational angle of the rotor)

V: small chamber volume at the time of completion of suction v: small chamber volume at an arbitrary rotational angle κ: polytropic index $P_1$: low suction pressure (=small chamber pressure at the time of completion of suction)

Accordingly, the following force is exerted on the unloader piston 145 in the embodiments of the present invention shown in FIGS. 23 and 24.

$$A \cdot P_1 + Kx = A \cdot P_2 \tag{5}$$

$$\therefore A(P_2 - P_1) = Kx$$

$$\therefore P_1 \cdot A \cdot \left(\frac{P_2}{P_1} - 1\right) = Kx$$

where,

A: sectional area of piston $P_1$: low pressure (suction pressure)

$P_2$: in-cylinder pressure of the first cylinder

K: spring constant of spring 146 x: shrinkage amount of spring

From the formulae (4) and (5), $$P_1 \cdot A\left\{\left(\frac{V}{v}\right)^{\kappa} - 1\right\} = Kx$$

Here, as previously mentioned, $(V/v)^{\kappa}$ is constant even if the suction pressure or discharge pressure of the compressor is changed, and A is constant, thus the above-described formula may be written as follows.

$$P_1 \propto Kx \tag{6}$$

That is, the position at which the unloader piston is balanced is determined only by the magnitude of the low pressure $P_1$ as described above.

FIG. 26 shows the operation of the aforementioned unloader piston. FIG. 26 uses the same reference numerals as those used in FIGS. 23 and 24.

FIG. 26*a* shows the mode of full load and FIG. 26*b* shows the mode of unload.

The in-cylinder pressure $P_2$ of the first cylinder 50-1 is applied to the right side of an unloader piston 145 through an in-cylinder pressure transmission groove 141, whereas the spring force Kx caused by a spring 146 and the load caused by the low pressure $P_1$ are applied to the left side of an the unloader piston 145. If the low pressure $P_1$ is however relatively high, the load caused by the in-cylinder pressure $P_2$ overcomes the low pressure $P_1$ and the load caused by the spring force Kx with the result that as shown in FIG. 26*a*, the unloader piston 145 is present at left to block a bypass hole 148, and the normal full load operation is carried out. If the low pressure $P_1$ falls, the load caused by the in-cylinder pressure $P_2$ on the right side of the piston becomes relatively low to move rightward the unloader piston 145. When a constricted portion of the unloader piston 145 comes to the bypass hole 148, the refrigerant gas during the compression stroke of the second cylinder chamber 50-2 passes through an escape hole 149 from the bypass hole 148 into the suction chamber 153 and the second cylinder enters into the unload operation.

FIG. 26*b* shows the state in which the low pressure falls extremely, and the unloader piston 145 bears on a portion on the right side to assume the maximum unload mode of operation. The amount of unload is determined by the amount (that is, a position of the unloader piston 145) in which the bypass hole 148 is blocked by the unloader piston 145, and this relies on only the low pressure $P_1$ as previously mentioned.

As described above, in the present embodiment, the switch of the operating mode from the full load to the unload or vice versa may be automatically accomplished by the magnitude of the suction pressure (low pressure) of the compressor instead of signals or the like from the outside, and the following significant effects may be obtained thereby:

(a) Only the piston and the spring are necessary for the unloader, and an extremely inexpensive unloader may thus be provided.

(b) The compressor need not be increased in size and the limitation on mounting the compressor is the same as the case where the unloader is not provided.

(c) The switch of the operating mode from the full load to the unloade or vice versa may be accomplished by making use of change in magnitude of the low pressure, whereby at the time of low speed, the full load results and at the high speed, the unload results. Thus, in the compressor for vehicles, in contrast to the prior art by which the air-conditioning capability at the time of high speed has increased more than needed with the result that power has been consumed more than needed, as previously mentioned, at the time of high speed, the low pressure falls and thus an entry into the unload operation is made to save power. When the load within the chamber of the air conditioner is small as in the morning, night, in spring and summer and in winter season, the suction pressure falls and therefore the compressor assumes the unload mode of operation to prevent a useless consumption of power.

(d) When the compressor stops, the low pressure and the high pressure are balanced. Thus, in FIG. 26*b*, the pressure on the low pressure side 150 of the unloader piston becomes equal to that of the in-cylinder pressure side 144 of the unloader piston (the pressure of the unloader piston chamber 143 is the same in any place) with the result that the unloader piston 145 is biased rightward by means of the spring 146 to assume the mode of unload operation. Accordingly, when the compressor is started, it is started in the mode of unload operation and therefore, a starting torque of the compressor is advantageously reduced.

The present invention has many applications as described hereinafter without departing from the aforementioned second inventive idea.

EXAMPLE 6

(See FIGS. 27 and 27*a*)

FIGS. 27 and 27*a* are sectional views of the unloader. The in-cylinder pressure $P_2$ of the first cylinder 50-1 applied to the in-cylinder pressure side 144 of the unloader piston 145 has more or less pulsation. If this pulsation is desired to be reduced, a volume 152 can be provided in the midst of the in-cylinder pressure transmission groove 141, as the volume 152 in FIG. 24. Since such a volume 152 functions as the so-called pulsation bumper, the pulsation is reduced, so that the pulsation caused by the in-cylinder pressure of the first cylinder chamber 50-1 is not transmitted to the in-cylinder pressure side 144 of the unloader piston, a better operation of the unloader is thus obtained.

If there is a possible leakage of gas during the compression stroke of the second cylinder chamber from a clearance between the unloader piston 145 closing the bypass hole 148 and the unloader piston chamber 143, the unloader piston may have a seal element such as $\phi$ ring mounted thereon. This example is shown in FIG. 27. Reference numeral 200 designates a $\phi$ ring mounted on the unloader piston 145, and the other members are the same as those shown in FIG. 26*b*.

A portion or place where the unloader piston is disposed is not limited to the front side block 126 shown in the embodiment. Also, places for forming the in-cylinder pressure transmission groove 14, the in-cylinder pressure detection hole 142, the bypass hole 148 and the like may be suitably determined according to the type of compressor or the like used.

Members which constitute the unloader may include, in addition to the unloader piston, those to which in-cylinder pressure and low pressure are loaded so that the unloader piston may be moved in proportion to the low pressure. For example, a bellows can be used in place of a spring shown in the aforementioned embodiments.

As is known, the bellows changes in length in proportion to a pressure difference between pressure inside and outside the bellows. The same effect as that of the specific embodiment may be obtained by a combination of said bellows and the unloader piston. FIG. 27*a* shows an embodiment which uses such a bellows. Reference numeral 251 designates a bellows; 252, a low pressure detection hole similar to the hole 147; 253, a second low pressure chamber of the unloader piston chamber 143 connected to the low pressure detection hole 252; and 254, an in-cylinder pressure transmission hole for transmitting the in-cylinder pressure into the bellows 251.

FIG. 27*a* shows an embodiment in which the in-cylinder pressure is applied to the interior of the bellows and the low pressure is applied to the exterior of the bellows, but a construction reverse to that of the above may be suitably employed.

Next, any type of compressor can be employed so long as it has a plurality of independent cylinder chambers. Also, any number of cylinder chambers is acceptable so long as they are more than two.

EXAMPLE 7

(See FIG. 28)

The present embodiment is connected with a rolling piston type two-vane compressor in accordance with the present invention.

In FIG. 28, reference numeral 202 designates a rotor casing; 203-1, 203-2, two vanes inserted movably to and from the rotor casing 202; 204, an eccentrically rotating rolling piston rotor; and 205, an unloader assembly comprising a spring and an unloader piston (not shown) in accordance with the present invention.

In such a construction, two independent cylinder chambers 201-1 and 201-2 are formed by the rotor casing 202, the two vanes 203-1 and 203-2, the rolling piston rotor 204 and both side blocks not shown. The broken line indicates an in-cylinder pressure transmission groove for introducing the in-cylinder pressure of the first cylinder chamber 201-1 into the unloader assembly 205. In this case, the unloader assembly 205 is designed to bypass the gas in the middle of compression in the second cylinder chamber shown in the above-described embodiments. The operation and effects are the same as in the above-described embodiments.

In the case that there are three cylinder chambers, the in-cylinder pressure of the first cylinder chamber is detected, and the number of cylinder chambers to unload the second and the third or the second cylinder chamber can be suitably determined.

EXAMPLE 8

(See FIG. 29)

The unloading method here used may be of a constitution by which the discharge amount of the second cylinder chamber et seq. is varied. In addition to the so-called bypass system in which the gas in the middle of compression is bypassed to return to the suction side as shown in the above-described embodiments, a system can be employed in which the unloader device of the present invention is arranged on the suction gas passage leading to the second cylinder chamber et seq. to control the supply of suction gas to the second cylinder chamber et seq.

FIG. 29 shows this embodiment corresponds to the conventional arrangement in FIG. 21, and like members bear like numerals.

Reference numeral 300 designates an unloader piston chamber disposed in the front casing 126; 301, an unloader piston; 302, a low pressure side of the unloader piston chamber 300; 303, a spring disposed on the low pressure side 302 of the unloader piston; 304, a low pressure detection hole for communicating the low pressure side 302 of the unloader piston chamber with the suction chamber 153; 305, an in-cylinder pressure side of the unloader piston chamber 300; 306, an in-cylinder pressure transmission groove for introducing the in-cylinder pressure from the first cylinder chamber (not shown) to the in-cylinder pressure side 305 of the unloader piston chamber 300; and 307, a suction hole extended through the front side block 126 for introducing the suction gas from the suction chamber 153 to the suction passage 54-2 connected to the suction port 55-2 of the second cylinder chamber 50-2.

The unloader mechanism of the present invention is provided so as to open and close the suction hole 307 for introducing the suction gas from the suction chamber 153 to the suction passage 54-2 of the second cylinder 50-2 as described above. That is, the low pressure and the in-cylinder pressure of the first cylinder are applied to the unloader piston 301 to thereby move the unloader piston 301 in proportion to the low pressure, to open and close the suction hole 307 of the second cylinder 50-2, and to control the supply of suction gas to the second cylinder 50-2. Thereby the discharge amount from the second cylinder 50-2 is controlled.

Alternatively, in the device having a plurality of vanes, the number of operating vanes can be suitably changed to control the discharge amount.

While in the above-described embodiments the vehicular air-conditioning and freezing compressor has been described and illustrated, it should be noted that the present invention may also be applied to compressors in any use for a small air conditioner, a package air conditioner, a show case, and the like, in addition to those for vehicles.

What is claimed is:

1. A capability control apparatus for a compressor including a compressor chamber, comprising means for forming a suction effect region separate from said compressor chamber, a bypass hole for providing communication between said compressor chamber and said suction effect region, said bypass hole having a first end opening to said compressor chamber and a second end opening to said suction effect region, and an unloader piston arranged in said suction effect region and being movably displaceable relative to the second end of said bypass hole for opening and closing said bypass hole, said unloader piston having first surfaces and separate oppositely directed second surfaces thereon and in said suction effect region the first surfaces being acted upon by the in-cylinder pressure of said compressor chamber and a suction opening arranged in said suction effect region so that the absolute pressure acting through said suction opening acts on said second surfaces, and said unloader piston arranged to open the second end of said bypass hole when the absolute pressure acting through the suction opening acts on said second surfaces rises above a predetermined value and to close the second end of said by-pass hole when the absolute pressure acting through the suction opening drops below the predetermined value.

2. The capability control apparatus for a compressor according to claim 1 wherein a volume type compressor having at least two separate compressor chambers, said unloader piston being loaded with the in-cylinder pressure of one of said compressor chambers and the absolute pressure acting through the suction opening, said unloader piston being moved in proportion to a magnitude of the absolute pressure acting through the suction opening, and the discharge amount of the at least one other said compressor chamber is automatically controlled by the position of said unloader piston.

* * * * *